United States Patent [19]

Bernath

[11] 4,147,044

[45] Apr. 3, 1979

[54] SAFE DOOR LOCKING ARRANGEMENT

[75] Inventor: Frank J. Bernath, Morton Grove, Ill.

[73] Assignee: A & B Safe Corporation, Chicago, Ill.

[21] Appl. No.: 813,498

[22] Filed: Jul. 7, 1977

[51] Int. Cl.[2] ..... E05B 63/14

[52] U.S. Cl. ..... 70/119; 70/1.5; 292/36

[58] Field of Search ..... 70/115, 114, 116, 117, 70/119, 120, 118, 1.5, 333; 292/337, 36, 166

[56] References Cited

U.S. PATENT DOCUMENTS

| | | | |
|---|---|---|---|
| 2,059,046 | 10/1936 | Singer et al. | 70/118 |
| 2,823,536 | 2/1958 | Watson | 70/1.5 |
| 3,187,526 | 6/1965 | Moler | 292/66 X |

FOREIGN PATENT DOCUMENTS

| | | | |
|---|---|---|---|
| 650252 | 8/1937 | Fed. Rep. of Germany | 70/118 |

*Primary Examiner*—J. Franklin Foss
*Attorney, Agent, or Firm*—Alter and Weiss

[57] ABSTRACT

The improved safe door locking arrangement includes a pair of oppositely extending dovetail locking bolts. The locking bolts are eccentrically attached to a crank wheel and are actuated responsive to rotation of the wheel. The wheel is spring loaded for easier operation. In the extended or locked position, a combination lock controlled bolt locks the dovetail bolts in their extended condition. A further feature is a safety bolt which in turn locks the combination lock controlled bolt in the locking position, if attempts are made to dislodge the combination lock.

10 Claims, 7 Drawing Figures

SAFE DOOR LOCKING ARRANGEMENT

This invention is concerned with locks and, more particularly, with locking arrangements for use on safe doors and the like.

There is a continual battle between safecrackers and designers of safe door locks. For example, in the past a bolt extending from only one side of a safe door has been used to lock the safe door. The safecrackers soon discovered that it was possible to "crack the safe" by removing the door from the hinges or by "forcing" the single bolt which proved to be the "weak link" in the locking arrangement. Accordingly, the lock designers instituted the use of dual bolt systems where the locking bolts extend in opposite directions to lock the door in place. However, difficulties were encountered in such an arrangement. For example, because of the friction generated at each of the bolts, a huge handle was required to provide a leverage necessary for operating the locking bolts to the locking position. Even so, the bolts were often jammed because of the added friction in the motion translating arrangement using oppositely extending bolts.

A further lock arrangement used a circular crank wheel to operate both oppositely extending bolts simulatenously. However, the crank must move the bolt actuating links beyond the center line, or equator, of the crank wheel to prevent forcing either one of the bolts to operate the crank in a reverse direction.

Such locking arrangements are locked and unlocked with either a key or combination lock enabling a handle to turn the crank. A weakness with this type of arrangement, however, is that if the key or combination operated lock is dislodged, the handle or the crank can be turned and the locking bolts moved back to the contracted position.

Another object of the present invention is to provide locking arrangements wherein a pair of oppositely reaching locking bolts are operated to use a single controlled crank which when rotated in one direction forces each of the locking bolts to an extended position, when rotated in the opposite direction forces each of the locking bolts to a contracted position.

A related object of the present invention is to provide locking bolts which are mounted on a dovetail base to stabilize the reciprocating linear movement of the bolts and thereby minimize friction and simultaneously strengthen the entire locking arrangement.

A further object of the present invention is to lock the locking bolts in place when in an extended position responsive to the operation of a key or a combination operated lock.

Yet a further object of the present invention is to provide auxiliary spring operated locking bolts which are operated responsive to attempts to dislodge the combination or key operated lock from the door. The auxiliary bolts then are operated to prevent contracting the dovetailed bolts; for example, by locking the key or combination lock operated bolts into positions locking the extended dovetail mounted bolts in their extended locking positions.

In a preferred embodiment of the present invention a crank wheel arrangement is operated by a handle. When the crank is rotated in a first direction, a pair of oppositely extending dovetail mounted locking bolts move linearly and smoothly from the unlocked to the locked position; i.e., from the dovetail locking bolts extend to retain the extended dovetail mounted bolts in the locking position.

Means such as an auxiliary spring-mounted bolt is held in the contracted position against the force of the spring by the casing or cover of the key or combination operated lock. The cover is moved when attempts are made to dislodge the key or combination operated lock from the door. Then the spring mounted auxiliary bolt automatically extends to prevent the locking bolts from being moved to the contracted position. The dovetailed locking bolts move with a minimum of friction and/or jamming, and are retained in the locking position even if the actual lock is dislodged from the door.

The above mentioned and other features and objects of the present invention and the manner of obtaining them will become more apparent and the invention itself will be best understood by making reference to the following description of an embodiment of the invention taken in conjunction with the accompanying drawings, wherein.

Figure 1:
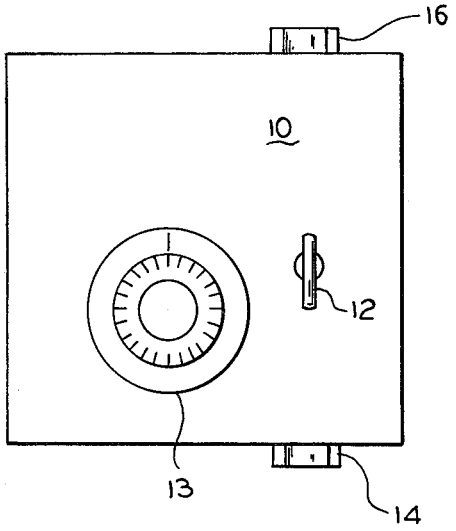
FIG. 1 is a front view of a safe door having the unique, inventive locking arrangement.

In FIG. 1 the safe door having the inventive locking arrangement is shown generally as 11. The safe door 10 has a handle 12 and a combination lock arrangement 13 on the front thereof. It should be understood that other types of locks, such as a key operated lock could also be used in place of the combination lock. Means are provided for assuring that the locking bolts move smoothly to minimize jamming and/or friction. More particularly, dovetail locking bolts are provided as shown at 14 and 16. The bolts 14 and 16 are shown extended in opposite directions.

A hinge assembly (not shown) would, of course, be on the side of the door opposite the handle so that when the handle 12 is turned and the dovetail locking bolts 14 and 16 are withdrawn, a force pulling on the handle causes the door to swing open.

Figure 2:
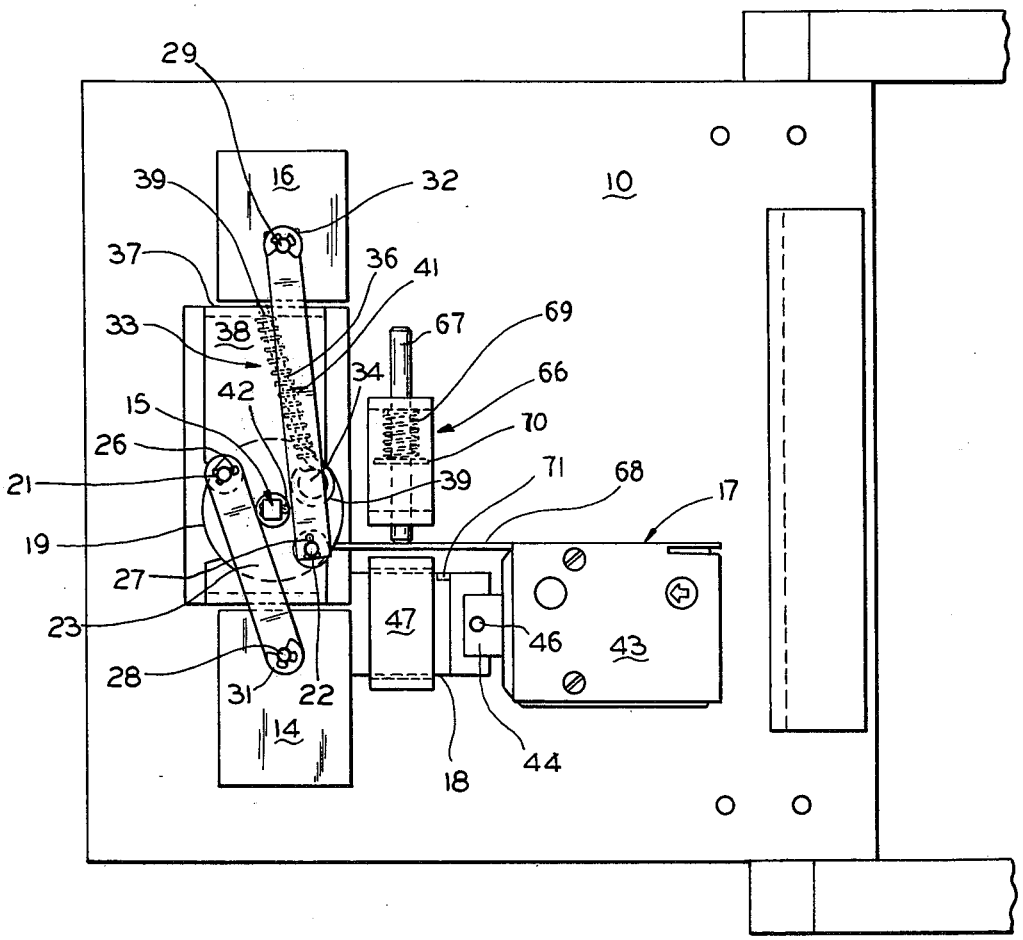
FIG. 2 is a plan view of the back of the safe door showing the locking arrangement in the unlocked position.

In FIG. 2 the back of the door is shown with the main components of the locking arrangement exposed. More particularly, in FIG. 2 the back of the combination or the key operated lock is shown generally as 17. Extending therefrom is a bolt assembly 18. This view of the locking arrangement shows it in the open or unlocked position. Accordingly, the dovetail locking bolts 14 and 16 are shown in the contracted position. A shaft attached to the handle 12 is fixedly attached to a crank wheel arrangement 19. Pivotally attached to the crank wheel through crank pivot pins 21 and 22 are a pair of extending link arms 23 and 24, respectively. Means, such as cotter pins 26 and 27, retain link arms on the crank pins. At their other ends the link arms 23 and 24 are connected to pivot pins 28 and 29 which pivotally connect the link arms to the dovetail locking bolts 14 and 16, respectively. The pivot pins 21, 22 and 28, 29 are fixedly attached to the crank wheel and the locking bolts, respectively. Means are provided for locking links to the pivot pins 28 and 29. The means shown herein are C clamps 31 and 32. Thus, responsive to turning handle 12, crank wheel 19 turns to force link arms 23 and 24 to their extended positions and thereby move the dovetail locking bolts 14 and 16 to the locking position.

Means are provided for facilitating forcing the dovetail locking bolts 14 and 16 both to the locked extended position and to the unlocked contracted position. More particularly, a spring-loaded toggle arrangement 33 is provided. The spring-loaded toggle arrangement 33 comprises a pivot pin 34 fixedly mounted on the crank wheel 19. Attached to the pivot pin is a hook-ended rod shown as 36. The hook-ended rod 36 extends through a hold 39 in flange 37 of bearing plate 38. The bearing plate 38 is spaced apart from but covers the crank wheel. The hook arrangement is loaded with spring 41. The hole 39 enables the passage of rod 36 but is too small for coil spring 41. Therefore, as the rod passes through the hole the spring compresses. Thus, when pin 34 is closest to flange 37 the spring 41 is in its most compressed state pushing on pivot pin 34 and tending to rotate crank wheel 19.

Figure 3:
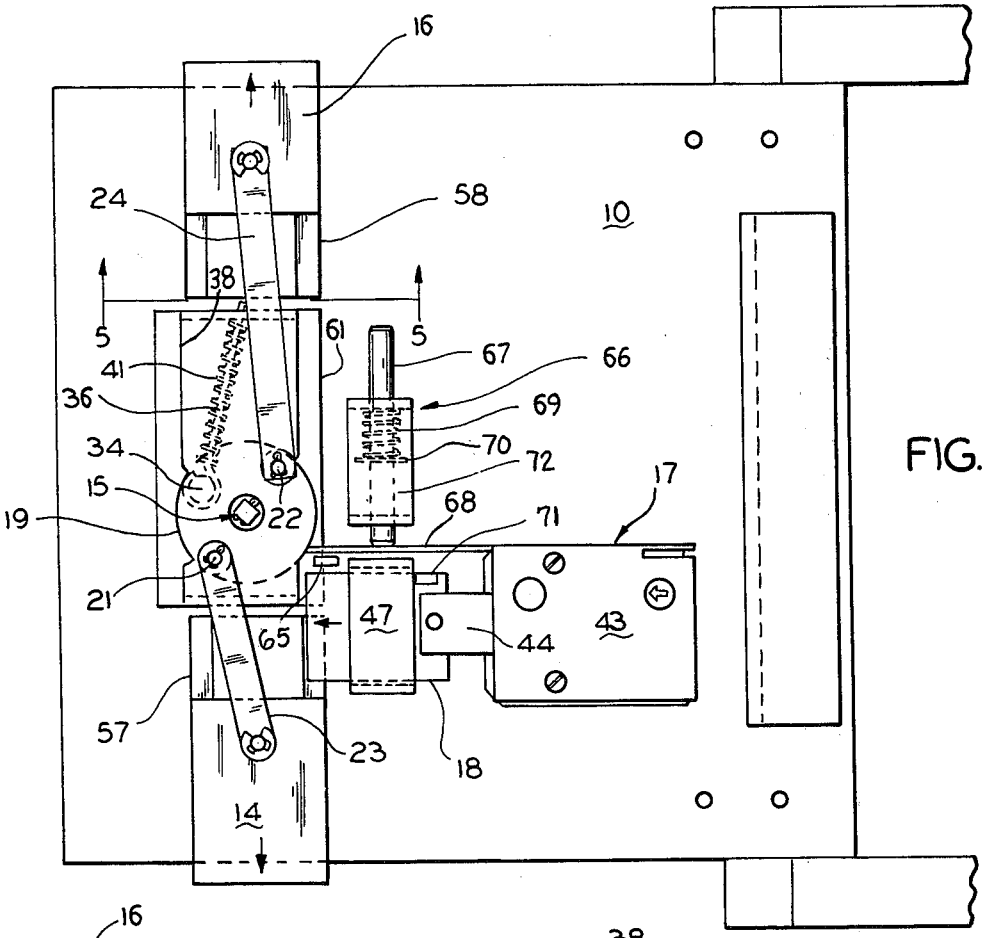
FIG. 3 is a plan view of the back of the door showing the locking arrangement in the locked position.

Comparing FIGS. 2 and 3 it can be seen that as the crank wheel 19 is turned in a counter-clockwise direction the link arms 23 and 24 are moved to the extended position. As pin 34 hits the center line of the locking bolts 14 and 16 then the spring 39 is in its most compressed condition. In the compressed state the spring 39 attempts to force the crank wheel 19 either to its locked or its unlocked position; and accordingly, tends to force the dovetail lock either to its extended or compressed position. Thus, the toggle arrangement aids the movement of the dovetail bolts both to their locked and unlocked positions.

It should be noted that the crank wheel 19 is attached to the handle 12 through the handle shaft, shown as rectangular shaft 15 and is locked in place by locking means such as cotter pins 42 extending through the shaft 15. The actual lock assembly 17 is within the lock case 43. Any ordinary type lock used in a safe, such as a key operated lock, or, preferably, as shown, a combination operated lock can be used. The operation of the lock assembly 17 in case 43 is not important. What is important is that extending from case 43 is a locking bolt 18 which is shown attached to the locking arrangement 17 by a shaft means 44. A fastener 46 is shown which passes through the shaft means 44 and attaches to the bolt 18.

Means are provided for guiding the locking bolt 18 to decrease the friction and chances of jamming. This means is shown as guide section 47 which has an inverted U-shape, with the bottom of its leg attached to the back of the safe door by means of welding, or the like. The bolt 18 slip-fits through guide section 47 and, normally is juxtaposed but non-contiguous to the side of the locking bolt 14.

Figure 6:
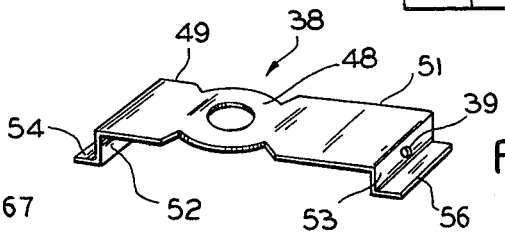
FIG. 6 is a pictorial showing of the bearing bracket that is over the crank wheel means.

The bearing plate 38 is shown in the pictorial drawing of FIG. 6. The plate 38 has an arcuate middle section 48 which generally sets over the crank wheel 19. The crank pins 21 and 22 may bear against the sides of the arcuate portion 48 to aid in stabilizing the translation of the crank's rotary motion to the linear motion of the locking bolts 14, 16 obtained through link arms 23, 24, respectively. The arcuate portion 48 is flanged by the substantially keystone sections 49 and 51. The keystone sections terminate in leg sections 52 and 53. The leg sections are shown as having slight flanges 54 and 56, respectively, which are used in fastening the bearing plate to the safe door by any well known fastening means, such as welding or the like. The leg section 53 is shown as having aperture 39 therein to enable passage therethrough of toggle rod 36.

FIG. 3 is a plan view of the lock arrangement in the locked position; i.e., with the locking bolts 14 and 16 extended outwardly past the periphery of the safe door. The safe door 10 is operated to the locked positon when the handle 12 is turned to rotate crank wheel 19 in a counter-clockwise direction. The rotary motion of the crank wheel 19 is converted to linear motion of locking bolts 14 and 16.

Figure 5:
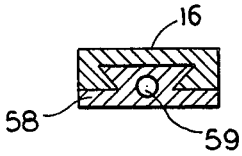
FIG. 5 is a sectional view showing the dovetail arrangement of the locking bolts and bases.

Means are provided for assuring a smooth and relatively jam-free translation from the rotary to the linear motion. More particularly, the locking bolts 14 and 16 are dovetailed to dovetail bases 57 and 58, respectively. The dovetail arrangement is shown particularly in FIG. 5 where locking bolt 16 is shown mounted on a dovetail base 58. It should be noted that the dovetail base 58 has an aperture 59 therein for receiving the toggle bolt 36 which protrudes through aperture 39 in the bearing plate 38 during the rotary motion of the crank wheel, and particularly, when the crank wheel 19 is positioned so that pin 34 of the toggle arrangement is closest to leg 53 of plate 38. At this time, of course, the spring 41 on the toggle arrangement is in its most compressed condition and aids in moving the crank wheel 19 to in turn move the dovetail locking bolts 14 and 16 to the locking position and to the open position.

Figure 7:
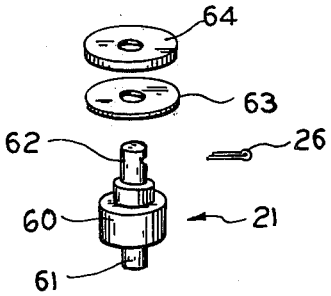
FIG. 7 is an exploded view of a crank pin assembly used to couple links to the crank wheel means.

The link arms 23 and 24 rotate about the crank pins 21 and 22 during the conversion from rotary to linear motion. The crank pins are shown in detail in the exploded view of FIG. 7. Therein, for example, crank pin 21 is shown as having an intermediate cylindrical section 60 which, in the assembly is immediately below the bearing plate 38. When the crank pin is inserted in the crank wheel by pressing the smaller cylindrical section 61 into a press-fit hole in the crank wheel 19, the upper cylindrical section 62 is the portion that bears against the arcuate section 48 of bearing plate 38. A washer 63 mounts on top cylindrical section and rests above the arcuate section 48 in the assembly. Preferably, the washer 63 is of metal or plastic of the type to reduce friction, while a second washer 64 is of neophrene or rubber and is mounted immediately below the link arms and above washer 63. It provides a resilient resting place for the link arms which fit on the top cylindrical section to further aid in providing a jam-proof and minimal friction type translation of the rotary to linear motion. The cotter pin 26 is set above the link arm 23 to lock the assembly in place without obstructing any pivotal or rotary motion around the pin.

Means are provided for locking the locking bolts in the extended position to prevent the return of the lock bolts to the contracted position in response to the operation of the handle means 12. More particularly, the lock assembly 17, as shown in FIGS. 2 and 3 includes bolt 18 which reaches beyond the inner periphery of the locking bolt 14. Thus, any attempt to return locking bolts 14 and 16 to the contracted position will be prevented because locking bolt 14 would come into contact with bolt 18 of locking assembly 17. Bolt 18, by preventing locking bolt 14 from reaching the contracted position, stops the crank wheel 19 from rotating and, therefore, also prevents locking bolt 16 from reaching a contracted position. Thus, the lock 17 operates to keep the safe door locked.

Means are provided for reinforcing the bolt 18 in preventing the locking bolts 14, 16 from returning to their unlocked positions. More particularly, a pillar means 65 is provided which is integral to a base unit 61. The base unit is welded to the back of the safe door 10 and is also used for mounting the bearing plate 38. The pillar 65 reinforces bolt 18 against forces which may be applied in attempting to force locking bolts 14 and 16 to the unlocked contracted position. Thus, with the safe door closed, once the locking bolts 14 and 16 are in the extended position, and bolt 18 is operated to its locking position, then the safe door 10 is locked in the closed position.

Safety auxiliary locking means are provided at assembly 66. Assembly 66 comprises a spring-loaded auxiliary locking bolt 67. The spring-loaded auxiliary locking bolt 67 is normally retained in its contracted position, as shown in FIGS. 2 and 3, since it abuts a bulkhead 68 which is attached to case 43 of locking assembly 17. However, if, for example, a safecracker attempts to dislodge the locking assembly 17, then the bulkhead 68 is moved or raised releasing bolt 67. In particular, when the bulkhead 68 is moved, a spring 69 which presses firmly against the flange 70 that is fixedly attached to bolt 67 forces the bolt through an aperture in cover 47 and into a slot 71 in locking bolt 18. Locking bolt 18 is thus locked into its position preventing the dovetail locking bolts 14 and 16 from being returned to their normal unlocked positions.

Figure 4:
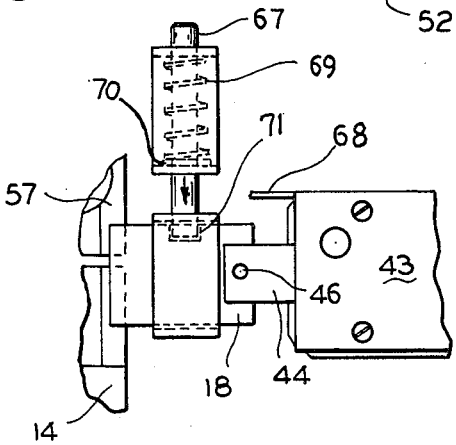
FIG. 4 is a showing of the auxiliary lock in the locked position.

The extended position of the auxiliary or safety bolt 63 is shown in detail in FIG. 4. Therein, for convenience, bulkhead 64 is shown as being knocked apart. However, in actuality, it need only be raised sufficiently to enable the bolt to fit between the bulkhead and the safe door 10 to pass through an aperture in the U-shaped bracket 47. The arrangement 68 has another inverted U-shaped cover 72 which, among other things, guides bolt 67 and also retains the spring 69 in place. The assembly 66 is thus spring-loaded and ready to operate.

It should be understood that the safety or auxiliary locking means 66 can, of course, be mounted in other positions on safe door 10. For example, it can be turned ninety degrees to abut against the crank wheel 19, when released, preventing it from turning when attempts are made to force the locking assembly 17 away from the safe door. Then, of course, lever means have to be provided to normally retain the spring 66 in the cocked position and to release the spring responsive to movement of case 43.

Thus, the unique door locking arrangement comprises a pair of dovetail locking bolts which are moved independently of an acutal lock. The actual lock provides the bolt which prevents the dovetail locking bolts from being moved to the unlocked position. The actual lock 17 is independent of the dovetail locking bolts except for its movement into relationship with the locking bolts to prevent their return to the unlocked position.

An auxiliary locking means is also provided which comes into operation responsive to tampering with the actual locking means 17 to prevent a safecracker from being able to open the safe door by dislodging the actual locking means 17 from the safe door.

While the principles of the invention have been described above in connection with specific apparatus and applications, it is to be understood that this description is made by way of example only and not as a limitation on the scope of the invention.

I claim:

1. An improved locking arrangement, said arrangement comprising door means to be selectively locked or opened, first locking bolt means extendable beyond the periphery of said door means, handle means on said door means for use in pulling said door open and for selectively operating said first locking bolt means to an extended position or to a retracted position relative to the periphery of said door means, lock means having a locked condition and an unlocked condition on said door means spaced apart from said handle means, said lock means including second locking bolt means having an extended and retracted position, and said second locking bolt means in the extended position being directly in the path of said first locking bolt means, thereby preventing said first locking bolt means from going to the retracted position from the extended position.

2. The improved door locking arrangement of claim 1 including crank means operated responsive to rotary motion of said handle means for selectively moving said first locking bolt means to the extended position or to the retracted unlocked position, and translating means for translating the rotary motion of said handle means to linear motion of said first locking bolt means.

3. The improved locking arrangement of claim 2 wherein said translating means includes crank means operated responsive to rotary motion of said handle means for selectively moving said first locking bolt means to the extended locked position or to the contracted unlocked position.

4. The improved locking arrangement of claim 1 wherein said means for preventing jamming comprises:

dovetailing said first locking bolt means onto a dovetail base whereby the linear motion of the first locking bolt means is stabilized.

5. The improved locking arrangement of claim 3 wherein toggle means are provided which add positive forces in the direction the first locking bolt means is going; either towards the contracted position or the extended position.

6. The improved locking arrangement of claim 1 wherein means are provided to prevent retraction of said first locking bolt means to the contracted position in the event said lock means is moved through attempts to dislodge the said lock means.

7. An improved door locking arrangement comprising a door, said door having a handle thereon, first lock bolt means selectively operated responsive to the movement of said handle means to an extended locked position or to a retracted unlocked position, lock means independent of said handle means provided to retain said first lock bolt means in the extended position, the improvement characterized in this that:

safety bolt means operated responsive to attempts to dislodge said independent lock means, and means are provided which cooperate with said lock means to prevent said first lock bolt means from being moved.

8. The improved locking arrangement of claim 7, said improvement further characterized in that said first lock bolt means is dovetailed and moves linearly between the locked and retracted positions on the dovetail base.

9. An improved door locking arrangement, said improved door locking arrangement comprising: a door, said door having a handle thereon for moving the door between the open and the closed position, a first set of locking bolts operated responsive to said handle means for moving between an extended locked position and a retracted unlocked position, crank means rotated responsive to rotation of said handle means, link means coupled to said crank means and connected to said set of locking bolts to cause said set of locking bolts to move linearly responsive to rotation of said crank means, means for mounting said set of locking bolts on the dovetail base thereby minimizing jamming of said set of locking bolts, toggle arrangement means attached to said crank means to provide forces assisting in moving said set of locking bolts, said toggle arrangement means comprising a spring loaded toggle rod, means for pivotally coupling said spring toggle rod to said crank means, means responsive to said crank means being moved approximately halfway between the position of the crank means with the set of locking bolts in the retracted position to maximize the compression on said spring loaded toggle rod so that the spring forces assist in moving said set of locking bolts to either a retracted or extended position, lock means mounted on said door, bolt means operated responsive to the operation of said lock means to the locked position for interfering with the movement of said set of locking bolts from the extended position to the retracted position, and safety bolt means operated responsive to movements of said lock means for further preventing the movement of said bolt means from said intefering position, said safety bolt means comprising a spring loaded bolt, bulk head means extending from said lock means perpendicular to said spring loaded bolt, said spring loaded bolt normally abutting said bulk head means, and slot means in said bolt means aligned with said safety bolt, whereby it said bulk head means is lifted responsive to attempts at dislodging said lock means, said spring loaded bolt is moved into said slot to prevent the movement of said bolt means.

10. An improved door locking arrangement, said improved door locking arrangement comprising: a door, said door having a handle thereon for moving the door between the open position and the closed position, a first set of locking bolts operated responsive to said handle means for moving between an extended locking position and a retracted unlocking position, crank means rotated responsive to rotation of said handle means, link means coupled to said crank means and connected to said set of locking bolts to cause said set of locking bolts to move linearly responsive to rotation of said crank means, means for mounting said set of locking bolts on a dovetail base, thereby minimizing jamming of the said set of locking bolts, toggle arrangement attached to said crank means to provide forces assisting in moving said set of locking bolts, said toggle means comprising a spring loaded toggle rod, means for pivotally coupling said toggle rod to said crank means, means responsive to said crank means being moved approximately halfway between the position of the crank means with the set of locking bolts in the extended position and the set of locking bolts in the retracted position to maximize the compression on said spring loaded toggle rod so that the spring forces assist in moving said set of locking bolts to either a retracted or extended position, lock means mounted on said door, bolt means operated responsive to operation of said lock means to the locked position for interfering with the movement of said set of locking bolts from the extended position to the retracted position, and safety bolt means operated responsive movements of said lock means for retaining the bolt means in the position interfering with the movement of the locking bolts thereby preventing the movement of said set of locking bolts from said extended position of said retracted position when attempts are made at dislodging the lock means.

* * * * *

UNITED STATES PATENT AND TRADEMARK OFFICE

CERTIFICATE OF CORRECTION

PATENT NO. : 4,147,044
DATED : April 3, 1979
INVENTOR(S) : Frank J. Bernath

It is certified that error appears in the above-identified patent and that said Letters Patent are hereby corrected as shown below:

Col. 1, line 20: "a" should be --the--;
line 42: After "position", insert --and--;
Col. 5, line 38: "68" should be --66--;
Col. 8, line 4: "it" should be --if--;
line 46: Between "responsive" and "movements", insert --to--;
line 50: Last word "of" should be --to--.

Signed and Sealed this

*First* Day of *January 1980*

[SEAL]

*Attest:*

SIDNEY A. DIAMOND

*Attesting Officer*

*Commissioner of Patents and Trademarks*